US007116245B1

(12) United States Patent
Bachelder

(10) Patent No.: US 7,116,245 B1
(45) Date of Patent: Oct. 3, 2006

(54) METHOD AND SYSTEM FOR BEACON/HEADING EMERGENCY VEHICLE INTERSECTION PREEMPTION

(75) Inventor: Aaron D. Bachelder, Irvine, CA (US)

(73) Assignee: California Institute of Technology, Pasadena, CA (US)

( * ) Notice: Subject to any disclaimer, the term of this patent is extended or adjusted under 35 U.S.C. 154(b) by 201 days.

(21) Appl. No.: 10/704,530

(22) Filed: Nov. 7, 2003

Related U.S. Application Data

(60) Provisional application No. 60/425,020, filed on Nov. 8, 2002.

(51) Int. Cl.
*G08G 1/07* (2006.01)

(52) U.S. Cl. ..... 340/906; 340/917; 340/919

(58) Field of Classification Search ..... 340/906, 340/907, 916, 917, 919, 924, 902
See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 3,881,169 | A | 4/1975 | Malach |
| 3,886,515 | A | 5/1975 | Cottin et al. |
| 4,017,825 | A | 4/1977 | Pichey |
| 4,162,477 | A | 7/1979 | Munkberg |
| 4,223,295 | A | 9/1980 | Bonner et al. |
| 4,230,992 | A | 10/1980 | Munkberg |
| 4,234,967 | A | 11/1980 | Henschel |
| 4,296,400 | A | 10/1981 | Becker Friedbert et al. |
| 4,433,324 | A | 2/1984 | Guillot |
| 4,443,783 | A | 4/1984 | Mitchell |
| 4,573,049 | A | 2/1986 | Obeck |
| 4,701,760 | A | 10/1987 | Raoux |
| 4,704,610 | A | 11/1987 | Smith et al. |
| 4,713,661 | A | 12/1987 | Boone et al. |

(Continued)

FOREIGN PATENT DOCUMENTS

EP 0 574 009 A2 12/1993

(Continued)

OTHER PUBLICATIONS

Co-pending U.S. Appl. No. 10/642,435, filed Aug. 15, 2003, entitled Emergency Vehicle Traffic Signal Preemption System.

(Continued)

*Primary Examiner*—Thomas Mullen
(74) *Attorney, Agent, or Firm*—Christie, Parker & Hale, LLP

(57) ABSTRACT

An emergency vehicle intersection preemption beacon/heading system and method that relies on the use of highly localized, low-power communication system. The system can be implemented in a "car-active" mode or a "car-passive" mode. In the "car-active" mode, the system includes a low-power transmitter providing a beacon channel for all emergency vehicles that allow them to separately communicate with each intersection for a very short period of time and within very close proximity. The localized low-power transmitter continuously transmits the emergency vehicle ID and heading every second. When within range, receivers at each intersection are able to lock the signal and begin receiving ID and heading data. In the "car-passive" system, each intersection will have a low-power, highly localized transmitter. In this embodiment, the intersection constantly sends out pulses of data. Thus when an emergency vehicle with a receiver encounters an intersection signal, it records the latitude/longitude location of that intersection and waits for the signal to disappear. Information regarding the emergency vehicle is transmitted to all surrounding intersections.

24 Claims, 11 Drawing Sheets

U.S. PATENT DOCUMENTS

| | | | | |
|---|---|---|---|---|
| 4,734,863 | A | | 3/1988 | Honey et al. |
| 4,734,881 | A | | 3/1988 | Klein et al. |
| 4,775,865 | A | | 10/1988 | Smith et al. |
| 4,791,571 | A | | 12/1988 | Takahashi et al. |
| 4,799,162 | A | | 1/1989 | Shinkawa et al. |
| 4,914,434 | A | | 4/1990 | Morgan et al. |
| 4,963,889 | A | | 10/1990 | Hatch |
| 5,014,052 | A | | 5/1991 | Obeck |
| 5,043,736 | A | | 8/1991 | Darnell et al. |
| 5,068,656 | A | | 11/1991 | Sutherland |
| 5,072,227 | A | | 12/1991 | Hatch |
| 5,083,125 | A | * | 1/1992 | Brown et al. ..... 340/906 |
| 5,119,102 | A | | 6/1992 | Barnard |
| 5,172,113 | A | * | 12/1992 | Hamer ..... 340/906 |
| 5,177,489 | A | | 1/1993 | Hatch |
| 5,187,373 | A | | 2/1993 | Gregori |
| 5,187,476 | A | | 2/1993 | Hamer |
| 5,214,757 | A | | 5/1993 | Mauney et al. |
| 5,334,974 | A | | 8/1994 | Simms et al. |
| 5,345,232 | A | | 9/1994 | Robertson |
| 5,539,398 | A | | 7/1996 | Hall et al. |
| 5,602,739 | A | | 2/1997 | Haagenstad et al. |
| 5,710,555 | A | | 1/1998 | McConnell et al. |
| 5,745,865 | A | | 4/1998 | Rostoker et al. |
| 5,889,475 | A | | 3/1999 | Klosinski et al. |
| 5,926,113 | A | | 7/1999 | Jones et al. |
| 5,955,968 | A | * | 9/1999 | Bentrott et al. ..... 340/906 |
| 5,986,575 | A | | 11/1999 | Jones et al. |
| 6,064,319 | A | | 5/2000 | Matta |
| 6,232,889 | B1 | | 5/2001 | Apitz et al. |
| 6,243,026 | B1 | | 6/2001 | Jones et al. |
| 6,326,903 | B1 | | 12/2001 | Gross et al. |
| 6,603,975 | B1 | | 8/2003 | Inouchi et al. |
| 6,621,420 | B1 | | 9/2003 | Poursartip |
| 6,909,380 | B1 | | 6/2005 | Brooke |

FOREIGN PATENT DOCUMENTS

| | | |
|---|---|---|
| FR | 2 670 002 A1 | 6/1992 |
| FR | 2 693 820 A1 | 1/1994 |

OTHER PUBLICATIONS

Co-pending U.S. Appl. No. 10/811,075, filed Mar. 24, 2004, entitled Emergency Vehicle Traffic Signal Preemption System.

Co-pending U.S. Appl. No. 10/696,490, filed Oct. 28, 2003, entitled Method and Apparatus for Alerting Civilian Motorists to the Approach of Emergency Vehicles.

Co-pending U.S. Appl. No. 10/965,408, filed Oct. 12, 2004, entitled Traffic Preemption System.

Co-pending U.S. Appl. 10/942,498, filed Sep. 15, 2004, entitled Forwarding System for Long-Range Preemption and Corridor Clearance for Emergency Response.

Co-pending U.S. Patent Appl. No. 10/960,129, filed Oct. 6, 2004, entitled Detection and Enforcement of Failure-to-Yield in an Emergency Vehicle Preemption System.

Co-pending U.S. Appl. No. 10/410,582, filed Apr. 8, 2003, entitled Emergency Vechile Control System Traffic Loop Preemption.

*Intelligent Investment*, World Highways/Routes Du Monde, Jan./Feb. 1997, p. 52.

*Traffic Preemption System for Emergency Vehicles Based on Differential GPS and Two-Way Radio*, Priority One GPS, Midwest Traffic Products, Inc., 4 pages.

*Traffic Signal Preemption for Emergency and Transit Vehicles Based on Differential GPS & Two-Way Radio*, Priority One GPS, Traffic Preemption System, 3 pgs.

*GPS and Radio Based Traffic Signal Preemption System for Emergency Vehicles*, Priority One GPS Specification for Emergency Vehicles, 7 pgs.

Emergency Preemption Systmes, Inc. website, 2 pgs.

Sonic Systems website, *Traffic Preemption and Priority Systems*, 2 pgs.

*Strobecom 1 Optical Preemption Detector*, 1 pg.

*Strobecom 1 Preemption Detector Assemblies*, 2 pgs.

*Strobecom 1 Interface Card and Card Cage*, 2 pgs.

*The Priority One GPS Concept for Emergency Vehicles*, http://www.mtp-gps.com/concept.html, Priority One GPS, 1 pg.

*Priority One GPS Traffic Preemption Hardware*, http://www.mtp-gps.com/hardware.html, Priority One GPS, 1 pg.

*The Traffic Preemption System for Emergency Vehicles Based on Differential GPS and Two-Way Radio*, http://www.greenf.com/traffic.htm, Greenfield Associates website, 1999, 6 pgs.

Zhaosheng Yang and Deyong Guan, *Study on the Scheme of Traffic Signal Timing for Priority Vehicles Based on Navigation System*, 2001 IEEE, pp. 249-254.

Veerender Kaul, *Microwave Technology: Will it Threaten the Dominance of Optical Signal Preemption Systems?*, May 8, 2002, 5 pgs.

Horst E. Gerland, *Traffic Signal Priority Tool to Increase Service Quality and Efficiency*, Prepared for: APTA Bus Operations Conference 2000, Salem Apr. 2000, 9 pgs.

M. Miyawaki, et al., *Fast Emergency Preemption Systems (FAST)*, 1999 IEEE, pp. 993-997.

K. Fox et al., *UTMCO1 Selected Vehicle Priority in the UTMC Environment (UTMC01)*, UTMC01 Project Report 1—Part A, Oct. 19, 1998, 45 pgs.

U.S. Department of Transportation, *Advanced Transportation Management Technologies*, Chapter 6, Transit-Management Systems, Publication No. FHWA-SA-97-058, Apr. 1997, pp. 6-1 through 6-23.

J.D. Nelson, et al., *The Modelling of Realistic Automatic Vehicle Locationing Systems for Service and Traffic Control*, Nov. 9, 1995-Nov. 11, 1995, pp. 1582-1587.

*Assessment of the Application of Automatic Vehicle Identification Technology to Traffic Management*, Appendix C: Evaluation of Potential Applications of Automatic Vehicle Monitoring to Traffic Management. Federal Highway Administration, Jul. 1977, 28 pgs.

Robert N. Taube, *Bus Actuated Signal Preemption Systems: A Planning Methodology*, Department of Systems-Design, University of Wisconsin-Milwaukee, May 1976, 120 pgs.

*Assessment of the Application of Automatic Vehicle Identification Technology to Traffic Management*, Federal Highway Administration, Jul. 1977, 44 pgs.

R. M. Griffin and D. Johnson, *A report on the first part of the Northampton Fire Priority Demonstration Scheme-the 'before' study and EVADE*, Crown Copyright 1980, 4 pgs.

P. M. Cleal, *Priority for Emergency Vehicles at Traffic Signals*, Civil Engineering Working Paper, Monash University, Dec. 1982, 38 pgs.

P. Davies, et al., *Automatic Vehicle Identification for Transportation Monitoring and Control*, 1986, pp. 207-224.

N. B. Hounsell, *Active Bus Priority at Traffic Signals*, UK Developments in Road Traffic Singaling, IEEE Colloquium, May 5, 1988, 5 pgs.

C. B. Harris, et al., *Digital Map Dependent Functions of Automatic Vehicle Location Systems*, 1988 IEEE, pp. 79-87.

P. L. Belcher and I. Catling, *Autoguide-Electronic Route Guidance for London and the U.K.*, 1989 IEEE Road Traffic Monitoring, pp. 182-190.

N. Ayland and P. Davies, *Automatic Vehicle Identification for Heavy Vehicle Monitoring*, 1989 IEEE Road Traffic Monitoring, pp. 152-155.

K. Keen, *Traffic Control at a Strategic Level*, 1989 IEEE Road Traffic Monitoring, pp. 156-160.

K. W. Huddart, *Chapter 7: Urban Traffic Control*, Mobile Information Systems, 1990 Artech House, Inc., 23 pgs.

S. Yager and E. R. Case, *A Role for VNIS in Real-Time Control of Signalized Networks?*, 1991, pp. 1105-1109.

R. F. Casey, et al., *Advanced Public Transportation Systems: The State of the Art*, U.S. Department of Transportation, Apr. 1991, 91 pgs.

M. F. McGurrin, et al., *Alternative Architectures for ATIS and ATMS*, IVHS Proceedings, May 1992, pp. 456-467.

A. Ceder and A. Shilovits, *A Traffic Signalization Control System with Enhancement Information and Control Capabilities*, 1992 Road Transport Informatics Intelligent Vehicle Highway Systems, pp. 325-333.

*Summary of Findings: Orange Country IVHS Review*, Orange Intelligent Vehicle/Highway Systems Study, JHK & Associates, Aug. 11, 1992.

*Automatic Vehicle Location/Control and Traffic Signal Preemption Lessons from Europe*, Chicago Transit Authority, Sep. 1992, 140 pgs.

J. D. Nelson et al., *Approaches to the Provision for Public Transport at Traffic Signals: A European Perspective*, Traffic Engineering Control, Sep. 1993, pp. 426-428.

M. D. Cheslow and S. G. Hatcher, *Estimation of Communication Load Requirements for Five ATIS/ATMS Architectures*, 1993 Proceedings of the IVHS America, pp. 473-479.

M. Kihl and D. Shinn, *Improving Interbus Transfer with Automatic Vehicle Location Year One Report*, Aug. 1993, 35 pgs.

Gunnar Andersson, article entitled *Fleet Management in Public Transport*, The 3rd International Conference on Vehicle Navigation & Systems, Oslo, Sep. 2-4, 1992, pp. 312-317.

James R. Helmer, *Intelligent Vehicle Highway Systems at Work in San Jose, California*, pp. 345-347.

Horst E. Gerland, *ITS Intelligent Transportation System: Fleet Management with GPS Dead Reckoning, Advanced Displays, Smartcards, etc.*, IEEE-IEE Vehicle Navigation & Information Systems Conference, Ottawa —VNIS '93, pp. 606-611.

Robert F. Casey, M. S., Lawrence N. Labell, M.S., *Evaluation Plan for AVL Implementation in Four Cities*, May 17-20, 1992 IVHS America Proceedings, 11 pgs.

N.B. Hounsell and M. McDonald, Contractor Report 88, Transport and Road Roach Research Laboratory, Department of Transport, *Bus priority by selective detection cover*, p. 8, p. 22.

David A. Blackledge et al., *Electronic Passenger Information Systems—Do They Give the Public What They Want?*, PTRC 19th Summer, Sep. 9-13, 1991 Annual Meeting, pp. 163-176.

American City & County Website, http://www.americancityandcounty.com, *City uses technology to track buses, emergency vehicles*, Jun. 1, 2001, 1 pg.

A. Kirson et al., *The Evolution of ADVANCE*, Development and Operational Test of a Probe-Based Driver Information System in an Arterial Street Network: a Progress Report, The 3rd International Conference on Vehicle Navigation & Information Systems, pp. 516-517.

Volume Two, The Proceedings of the 1992 Annual Meeting of IVHS America, Surface Transportation and the Information Age, May 17-20, 1992, Newport Beach, CA, 13 pgs.

Labell et al., *Advanced Public Transportation Systems: The State of the Art, Update '92*, U.S. Department of Transportation Federal Transit Administration, 97 pgs.

Stearns et al., *Denver RTD's Computer Aided Dispatch/Automatic Vehicle Location System: the Human Factors Consequences*, U.S. Department of Transportation, Federal Transit Administration, Sep. 1999, 82 pgs.

APTS Project Summaries, http://www.itsdocs.fhwa.dot.gov, *Advanced Public Transportation Systems (APTS) Project Summaries*, Jun. 1996, Office of Mobility Innovation, 33 pgs.

Brendon Hemily, PhD., *Automatic Vehicle Location in Canadian Urban Transit; a Review of Practice and Key Issues*, Dec. 1988, AATT Conference Feb. 1989, pp. 229-233.

Canadian Urban Transit Association, *Proceedings, The International Conference on Automatic Vehicle Location in Urban Transit Systems*, Sep. 19-21, 1988, Ottawa, Canada, 17 pgs.

1991 TAC Annual Conference, *Proceedings* , vol. 4, Transportation: Toward a Better Environment, 21 pgs.

Casey et al., *Advanced Public Transportation Systems: The State of the Art*, U.S. Department of Transportation Urban Mass Transportation Administration, Component of Departmental IVHS Initiative, Apr. 1991, 91 pgs.

U.S. Department of Transportation, *German "Smart-Bus", Potential for Application in Portland, Oregon, vol. 1 , Technical Report*, Jan. 1993, Office of Technical Assistance and Safety, Advanced Public Transportation Systems Program, A Component of Departmental IVHS Initiative, 107 pgs.

Arup, *Traffic Management for Bus Operations Main Report*, Prepared by Ove Arup Transportation Planning for the Public Transport Corporation, Dec. 1989, 123 pgs. (front and back).

Randy D. Hoffman, et al. *DGPS, IVHS Drive GPS Toward Its Future*, GPS World Showcase, Dec. 1992, 1 pg.

Ivan A. Getting, *Getting-The Global Positioning System*, IEEE Spectrum, Dec. 1993, pp. 37-38, 43-47.

IVHS Study—Strategic Plan, Centennial Engineering, Inc., p. 31.

Horst E. Gerland, *FOCCS—Flexible Operation Command and Control System for Public Transport*, PTRC 19th Summer Sep. 9-13, 1991 Annual Meeting, pp. 139-150.

L. Sabounghi et al., *The Universal Close-Range/Vehicle Communication System Concept The Numerous Applications of the Enhanced AVI*, 1991 TAC Annual Conference, pp. A41, A43-A62.

R. L. Sabounghi, *Intelligent Vehicle Highway System—The Universal Close-Range Road/Vehicle Communications System Concept—The Enhanced AVI and Its CVO Applications*, 1991, VNIS '91, Vehicle Indication and Information Systems Conference Proceedings, pp. 957-967.

Clarioni, et al., *Public Transport Fleet Location System Based on DGPS Integrated with Dead Reckoning*, Road Vehicle Automation, Jul. 12, 1993, pp. 259-268.

Bernard Held, *Bus Priority: A Focus on the City of Melbourne*, Aug. 1990, Monash University, pp. 157-160, and 180-189.

* cited by examiner

METHOD AND SYSTEM FOR BEACON/HEADING EMERGENCY VEHICLE INTERSECTION PREEMPTION

Priority of U.S. Provisional Application Ser. No. 60/425,020 filed Nov. 8, 2002 is hereby claimed. The invention described herein was made in the performance of work under a NASA contract and is subject to the provisions of Public Law 96-517 (35 U.S.C. 202) in which the Contractor has elected to retain title.

BACKGROUND OF THE INVENTION

1. Field of the Invention

This invention is a method and system for emergency vehicle intersection preemption using a beacon/heading technology for alerting civilian motorists to the approach of emergency vehicles and more particularly relates to an emergency vehicle intersection preemption system that uses a highly localized, low-power communication system.

2. Background Information

Numerous in-car distractions and/or technology innovations have reduced the effectiveness of emergency vehicle sirens. Specifically, in-car stereo systems and advances in "air-type, noise-reduction" vehicles have limited motorists' awareness of their outside environment. Even the loudest emergency vehicle sirens and horns have limited effect. For that reason, there is a need for in-vehicle alert systems or indicators that warn a civilian motorist of the approach of emergency vehicles that will warn them of approaching emergency vehicles in the area in addition to the audio alert of sirens.

It is therefore one object of the present invention to provide an alert system to preempt traffic signals and alert civilian motorists to approaching emergency vehicles.

It is therefore another object of the present invention to provide a beacon/heading emergency vehicle intersection preemption system and method that utilizes a highly localized, low-power communication system.

Yet another object of the present invention is to provide an emergency vehicle intersection preemption system that utilizes a highly localized, low-power communication system in each emergency vehicle for controlling the operation of traffic lights at intersections.

Still another object of the present invention is to provide an emergency vehicle intersection preemption beacon/heading system utilizing highly localized, low-power communication system at each intersection to control the traffic lights.

Yet another object of the present invention is to provide an emergency vehicle intersection preemption system in which emergency vehicle has a transmitter that continuously transmits its identification (ID) and heading every second to a receiver at intersections.

Still another object of the present invention is to provide an emergency vehicle intersection preemption system in which a low-power transmitter in emergency vehicles allow them to separately communicate with each intersection for a very short period of time, and within very close proximity.

BRIEF DESCRIPTION OF THE INVENTION

The purpose of the present invention is to provide emergency vehicle intersection preemption system that utilizes beacon/heading technology in the form of a highly localized, low-power communication system in the emergency vehicle or in the alternative at each intersection.

The technology in the present invention is aimed at reducing emergency vehicle traffic-related accidents when on a call that often occur at intersections. The beacon/heading technology of the invention is also aimed at increasing civilian motorist's awareness and response to approaching emergency vehicle.

The beacon/heading emergency vehicle intersection preemption technology disclosed herein is related to prior U.S. Pat. No. 4,704,610 of Smith et al issued Nov. 3, 1987 and U.S. Pat. No. 4,775,865 of Smith et al issued Oct. 4, 1988 and two pending applications. One pending application Ser. No. 10/410,582, filed Apr. 8, 2003, is for use with traffic-loop intersection preemption while the second application Ser. No. 10/642,435, filed Aug. 15, 2003, now U.S. Pat. No. 6,940,422, is for an emergency intersection preemption and visual warning system. The patents and applications referred to above are incorporated herein by reference.

Traffic loops can be used as an effective, accurate, low-cost alternative to transit preemption signal based preemption. The traffic loop strategy uses a forward prediction algorithm to perform statistical calculations to make long-range forecasting (clearing intersections long before emergency vehicles arrive). While these traffic loops are an efficient and cost-effective strategy, an alternative, yet related, method for detection of emergency vehicles is disclosed herein.

The heading/beacon technology disclosed herein relies on the use of highly localized, low-power communication system. This system is in addition to the medium-range wireless network used for forward propagation of position data. Using an added low-power RF channel (a beacon channel), vehicles are able to separately communicate with these intersections for a very short period of time, and within very close proximity (e.g., 50 to 100 feet). The beacon-based system disclosed herein is implemented in two different approaches. In one a localized transmitter is placed in the vehicle and is referred to as a "car active" approach or system while in an alternate embodiment, the localized transmitter is placed in the controller of the traffic lights at an intersection and is called a "car passive" system.

In the "car active" system, a short-range transmitter in an emergency vehicle continuously transmits its ID and heading every second. When within range, the intersection is able to lock the signal and begin receiving ID and heading data. While the car remains in range, the intersection simply monitors the existence of the signal and logs the data and preempts traffic light operation. Upon a lapse of communication, the intersection computer assumes that the emergency vehicle has passed through the intersection. It reviews its record and compares the vehicle's last known heading to the previous database. Importantly, the actual location of vehicle is not required; only the final heading is needed to estimate the location/direction of the car when exiting an intersection. If the last known heading and heading trajectory comply, the intersection overlays the information on its local map and predicts the next intersection that will require preemption. This preemption data is then forwarded to all surrounding intersections.

The "car passive" system requires an intersection to have a localized transmitter and constantly send out pulses of data (as opposed to the emergency vehicle). When the emergency vehicle encounters an intersection signal, it records the latitude/longitude location of that intersection and waits for the signal to disappear. When the signal is lost, a computer in the vehicle combines its last known heading (outbound heading when the signal was lost) with the location ID of the intersection (LAT/LON). This information is then forwarded to all surrounding intersections. If the emergency vehicle is equipped with dead-reckoning hardware/software, the on-board computer in the vehicle will also use the last-known position data to re-calibrate (snap) its dead-reckoning location to that intersection. The emergency vehicle will continue to broadcast its location using dead-reckoning predictions.

The beacon transmitter/receiver pair (i.e., transceivers) are short-range systems similar to wireless garage door remote system, with approximate range of 50 to 100 feet. Thus the system requires only standard, off-the-shelf equipment, capable of approximately 10 bytes/second data rate. Built-in collision detection/avoidance is preferable.

The medium-range transceivers require a range of several blocks (500–1,000 feet) adequate to transmit/receive data between neighboring intersections. This requires standard, off-the-shelf equipment, capable of up to 100 bytes/second. Built-in collision detection/avoidance is highly preferable. For intersection controller architecture that support piggy-back data, the medium-range transceivers can be replaced/augmented with existing local area networks (LAN) intersection communications (i.e., fiber, FSK, etc.).

The "car active" design is preferable where the emergency vehicle provides the beacon and transmits vehicle ID and heading. This system only requires a very simple, very inexpensive hardware module in the vehicle at very modest cost. The remainder of the hardware and any software is embedded in the controller at each traffic light controlled intersections. The "car active" mode also allows each intersection to match the heading data points against its own local street map, that allows more reliable outbound triggering.

In some cases, the "car passive" design might be a better choice than a "car active" design. One example is the situation where local traffic engineers want to reduce the preemption interference with normal traffic flow. In this case, a more optimized triggering system is preferred, one that reduces the overall time intersections are preempted. The "car passive" system would be more appropriate in this case because a dead-recking system can be added-on to the vehicles. In this case, vehicles provide more timely position updates to the intersection. Since this reduces the error in estimated time of arrival (ETA) calculations, intersections can be preempted for less time.

When an outbound vehicle triggers communications between intersections, the decision-making at either the source or destination intersection can be implemented. As mentioned earlier, the source intersection can analyze its own local street map and determine which intersection the vehicle will next encounter. It can then issue a command directly to that destination intersection to preempt traffic lights. As an alternative, the source intersection can simply broadcast the event (source intersection ID/location and vehicle ID/outbound-direction) and allow neighboring intersection to independently determine if the vehicle is headed in their direction. The disclosure hereinafter makes the assumption the approach calculation is performed at neighboring intersections. This allows only one message to be broadcast and does not require propagation of the event with closely spaced successive intersections.

An on-board diagnostic computer system (OBD) in newer vehicles allow data such as vehicle heading and vehicle identification numbers (VIN) to be read from the vehicle computer. The heading-beacon system is fully compatible with acquiring this data from the vehicle computer bus, along with any future add-on parameters for Code 3-switch-box/OBD integration. Using existing vehicle computer bus for all these inputs drastically reduces the integration cost of an already cheap vehicle module.

The system disclosed herein is not without some obvious tradeoffs. Each time a vehicle exits an intersection, neighboring intersections perform an ETP (estimated time for preemption) window calculation (MIN, MAX) that predicts when and whether the vehicle will need to preempt each intersection. For closely spaced intersection, this time window is quite small and would have minimal disruption of traffic flow at the intersection. However as the distance between equipped intersections become greater than several blocks, the ETP window can become unacceptably long. For this reason, intersections that are many blocks apart, or that have large variability in traffic speeds, may cause major traffic closure disruptions due to the long preemption times. A solution to this problem is to install additional intersection modules between equipment intersections wherein there is a long distance between intersections.

The above and other objects, advantages, and novel features of the invention will be more fully understood from the following detailed description and the accompanying drawings, in which:

DETAILED DESCRIPTION OF THE INVENTION

Figure 1:
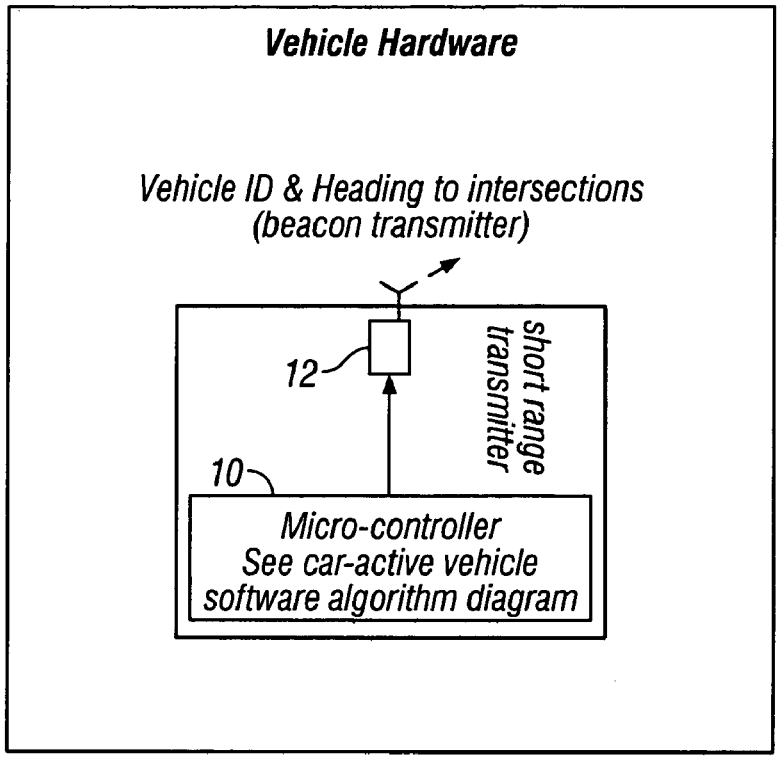
FIG. 1 is a block diagram of vehicle hardware for the beacon-heading emergency vehicle intersection preemption system according to the invention.

The "car-active" embodiment for the emergency vehicle intersection preemption system is illustrated in FIGS. 1 through 6. Referring to FIG. 1, the "car-active" system has a micro-controller 10 on board an emergency vehicle and a short range, highly localized, low-power transmitter 12 for transmitting vehicle ID and heading to intersections the emergency vehicle is approaching. Micro-controller 10 uses a software algorithm which will be described in greater detail hereinafter. Beacon transmitter 12 continuously transmits ID and heading every second.

Figure 2:
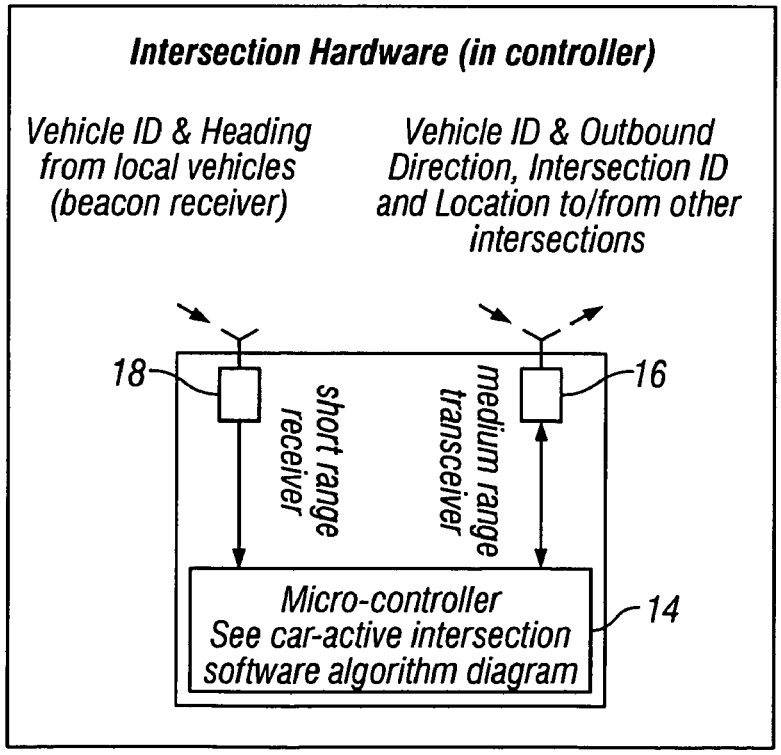
FIG. 2 is a block diagram of the intersection hardware for the beacon-heading emergency vehicle intersection preemption system.

With reference to FIG. 2, each intersection will have a micro-controller 14, a medium-range transceiver 16, as well as a short-range receiver 18. Micro-controller 14 has a software algorithm that will be described in greater detail hereinafter. Medium-range transceiver 16 transmits vehicle ID and outbound direction, intersection ID, and location to and from other intersections. Short-range receiver 18 receives vehicle ID and heading from beacon transmitter 12 located in the local emergency vehicle.

Figure 6:
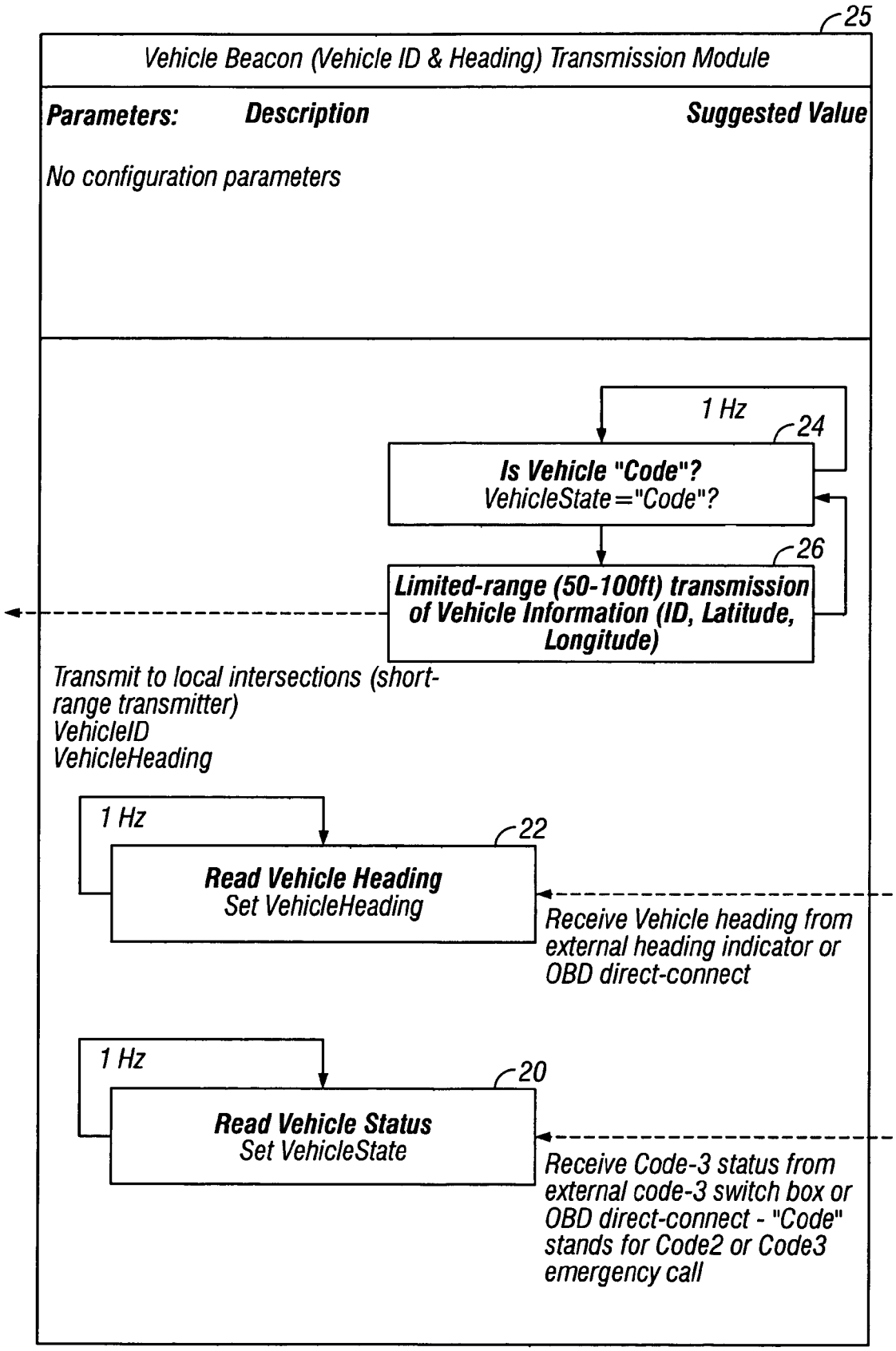
FIG. 6 is a diagram of the "car-active" software algorithm for the vehicle beacon transmission module.

The vehicle beacon transmission module 25 for the software algorithm in micro-controller 10 is illustrated in the diagram of FIG. 6. The vehicle beacon transmission module software algorithm 25 includes a read vehicle status routine 20 that receives a Code 3 status from an external code switchbox or OBD (on board diagnostics) direct-connect computer. The module also has a read vehicle heading 22 receiving vehicle heading from external heading indicator or an OBD direct-connect computer. Also included in the vehicle beacon transmission module is an in-vehicle code routine 24 and a limited range transmission vehicle information routine 26 that transmits to local intersections vehicle ID and vehicle heading.

Figure 4:
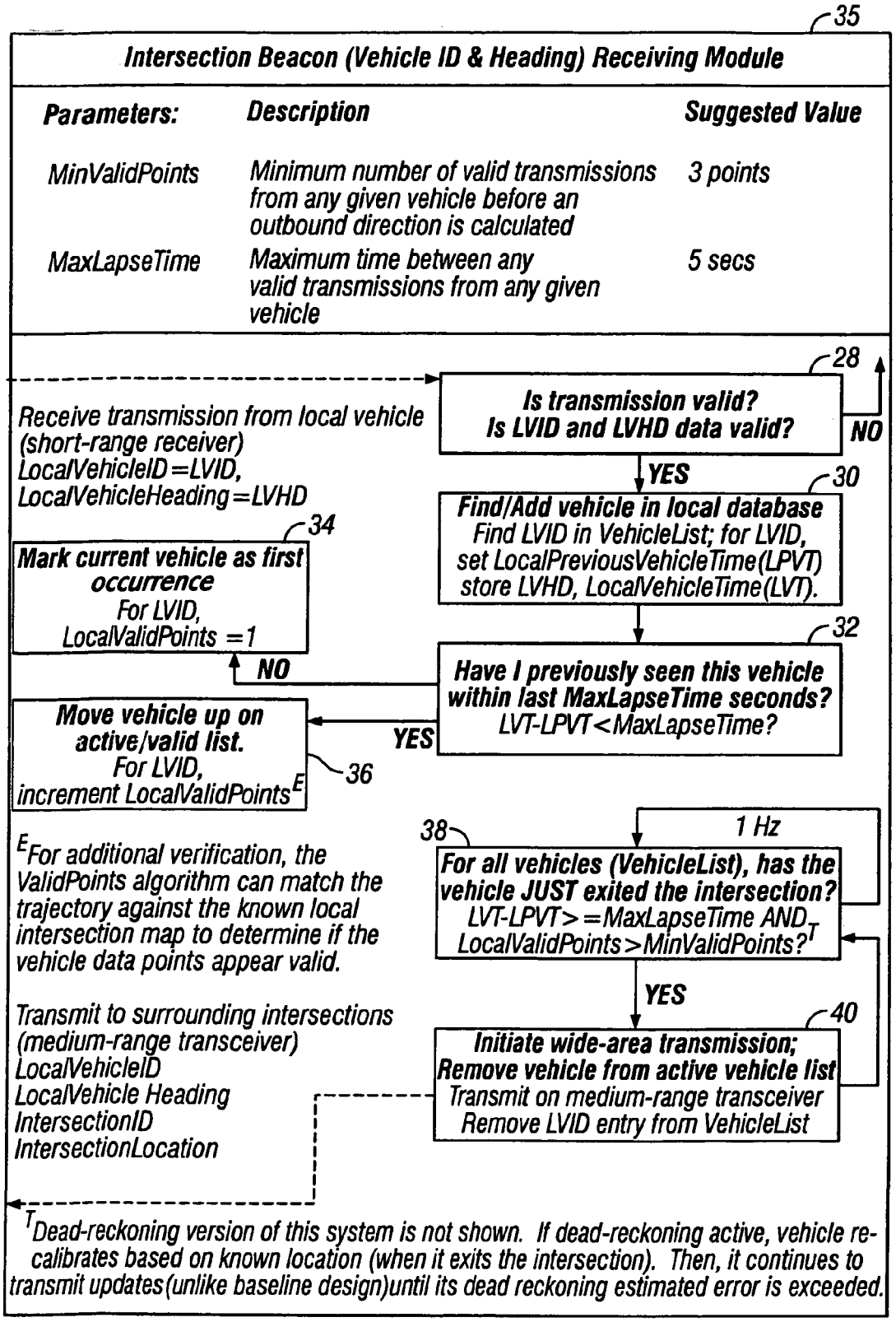
FIG. 4 is a diagram illustrating the design of the "car-active" software algorithm for the intersection beacon receiving module.
Figure 5:
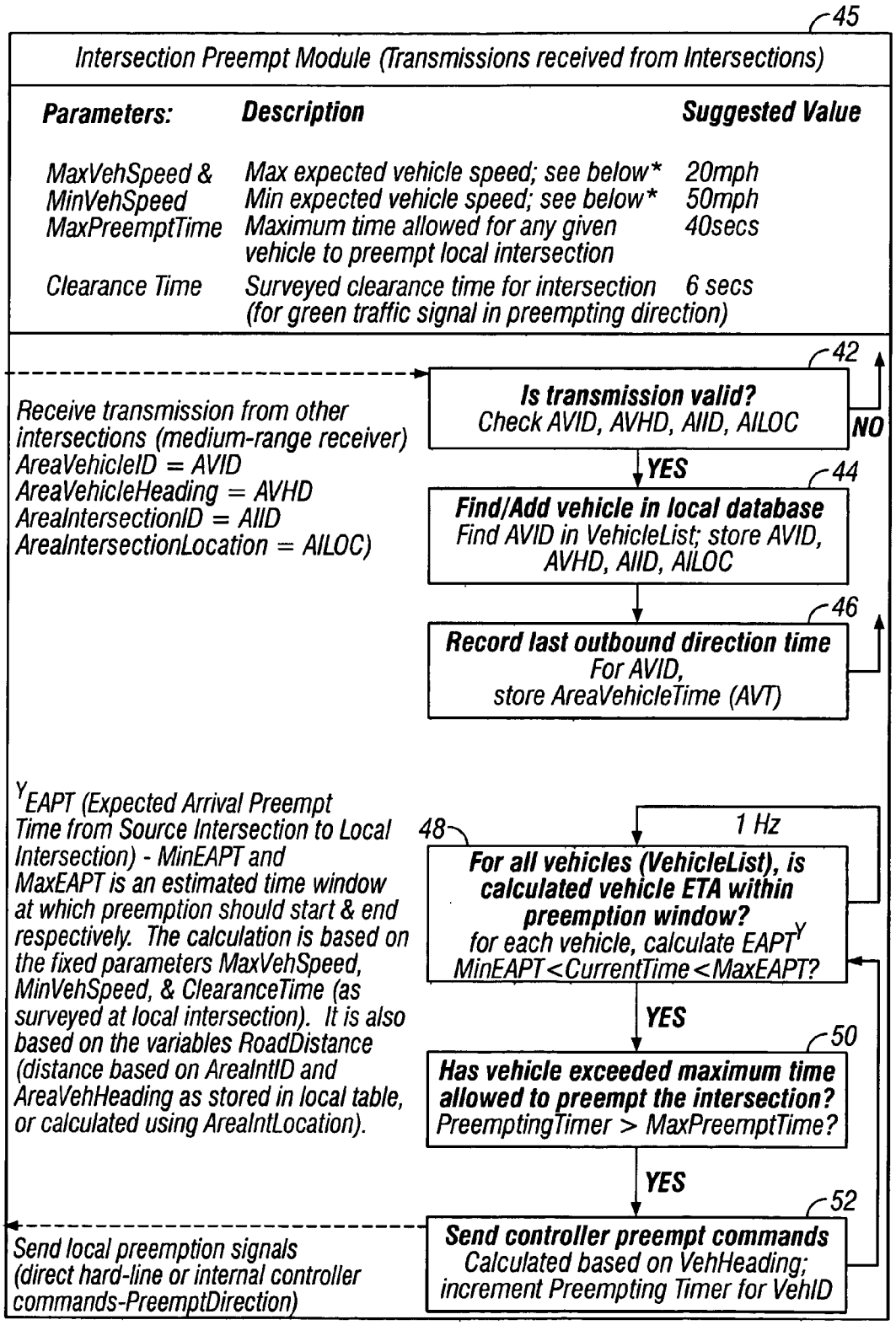
FIG. 5 is a diagram illustrating the "car-active" software algorithm for the intersection preempt module.

The software algorithm for micro-controller 14 in the intersection hardware is illustrated in FIGS. 4 and 5. Each traffic light controlled intersection has a beacon receiving module 35 in micro-controller 14 that receives a transmission from a local vehicle and determines if the transmission is valid 28. If the transmission is valid, it activates the find/add vehicle in local database 30. The module also includes a query whether this vehicle has been previously seen 32. If the vehicle has not been previously seen then a mark current vehicle as first occurrence 34 occurs. If the vehicle has been previously seen then the algorithm moves the vehicle up on active/valid list 36. Also for the intersection beacon receiving module 35, the algorithm determines whether the vehicle has just exited an intersection 38 and initiates a wide area transmission 40. This results in a transmission to surrounding intersections from a medium-range transceiver of the local vehicle ID, local vehicle heading, intersection ID, and intersection location. The vehicle just exited the intersection as determined in operation 38 recalibrates based on known location if dead-reckoning is active. The system continues to transmit updates until dead-reckoning estimated error is exceeded.

The intersection software algorithm diagram for the micro-controller 14 for intersection preempt module 45 is illustrated in FIG. 5. Intersection preempt module 45 receives transmission from other intersections such as area vehicle ID, area vehicle heading, area intersection ID, and area intersection location which checks if the transmission is valid 42. If the transmission is valid, the next step is to find the vehicle in the local database 44 and record the last outbound direction time 46. Intersection preempt module 45 also has a check for whether the vehicle ETA is within the preemption window 48 and if it is, determines whether the vehicle has exceeded maximum time allowed to preempt the intersection 50. If the maximum preemption time has been exceeded, controller preempt commands are then sent 52. Local preempt signals are thus sent.

The vehicle ETA calculation within preemption window 48 calculates the EAPT which is Expected Arrival Preempt Time from the source intersection to a local intersection. A maximum and minimum of the calculated value is an estimated time window in which preemption should start and end respectively. This calculation is based on fixed parameters such as maximum vehicle speed, minimum vehicle speed, and clearance time.

Figure 3:
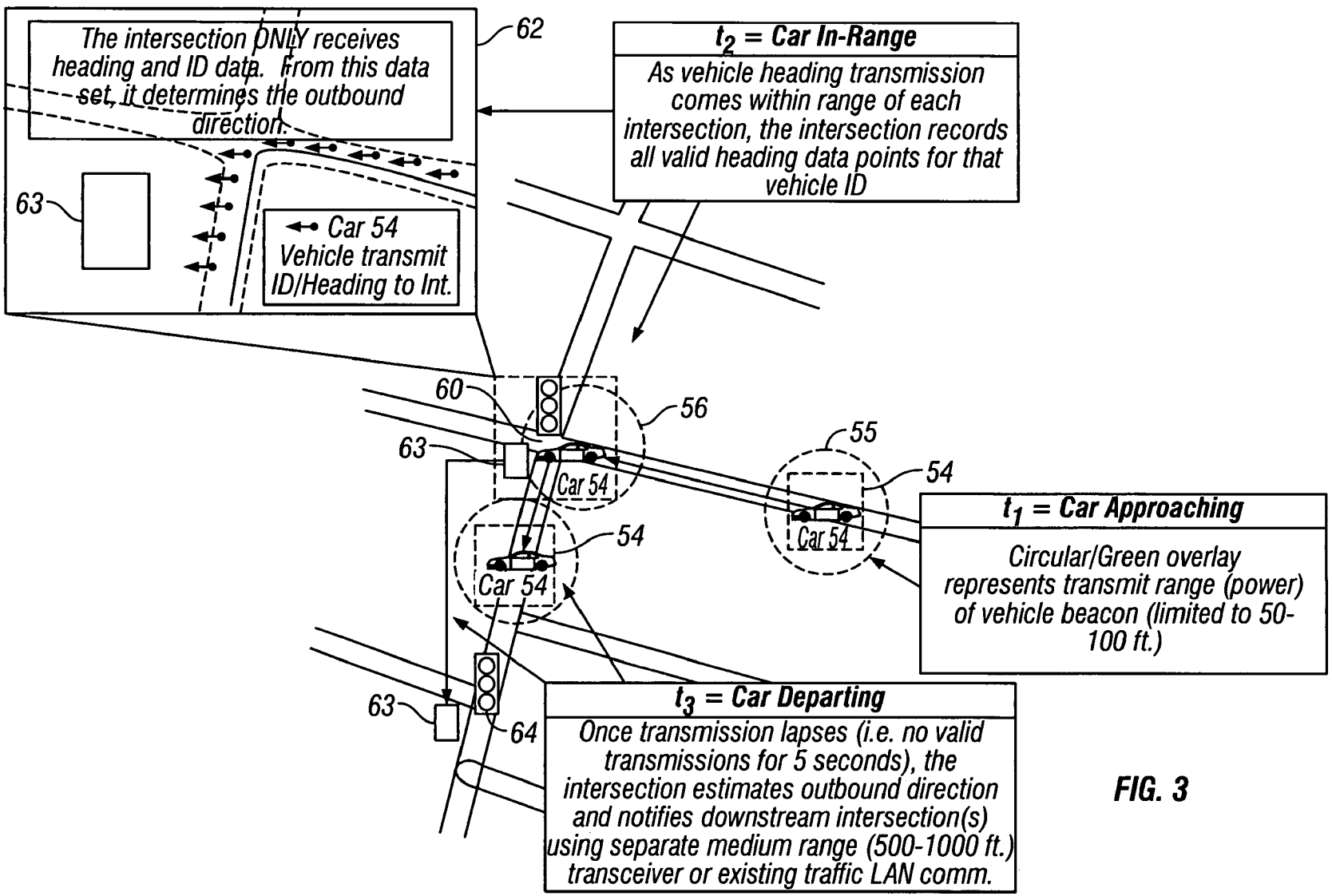
FIG. 3 is a diagram illustrating the timing sequence of the heading-beacon emergency vehicle intersection preemption system for a "car-active" system.

The timing sequence for the "car-active" heading/beacon emergency vehicle preemption system is illustrated in FIG. 3. In this figure, an emergency vehicle 54 is shown approaching an intersection indicated by circle 56. Emergency vehicle 54 is thus at timing sequence $t_1$ car approaching with circle 55 around the car representing the relative transmit range (power) of the transmitter in the vehicle generating the beacon. This distance is preferably limited to 50 to 100 feet. Emergency vehicle 54 is then indicated near the intersection by circle 56 and at timing sequence $t_2$. This means emergency vehicle 54 is in-range of intersection 60. Intersection 60 records all valid heading data points for that emergency vehicle ID. As shown in zoomed view 62, intersection 60 receives only heading and ID data. Controller 63 at each traffic light controlled intersection thus determines the outbound direction from this data. That is, emergency vehicle 54 transmits ID heading to controller 63 at intersection 60 which is received by short-range receiver 18 and micro-controller 14. At time sequence $t_2$, all valid heading data points for that vehicle ID is recorded at intersection 60.

At time sequence $t_3$, emergency vehicle 54 is departing intersection 60. When there is no transmission for at least five seconds, transmission lapses and controller 63 at intersection 60 estimates outbound direction and notifies downstream intersection 64 using separate medium-range (500–1,000 feet) transceiver or existing traffic LAN communications to estimate the outbound direction.

Figure 7:
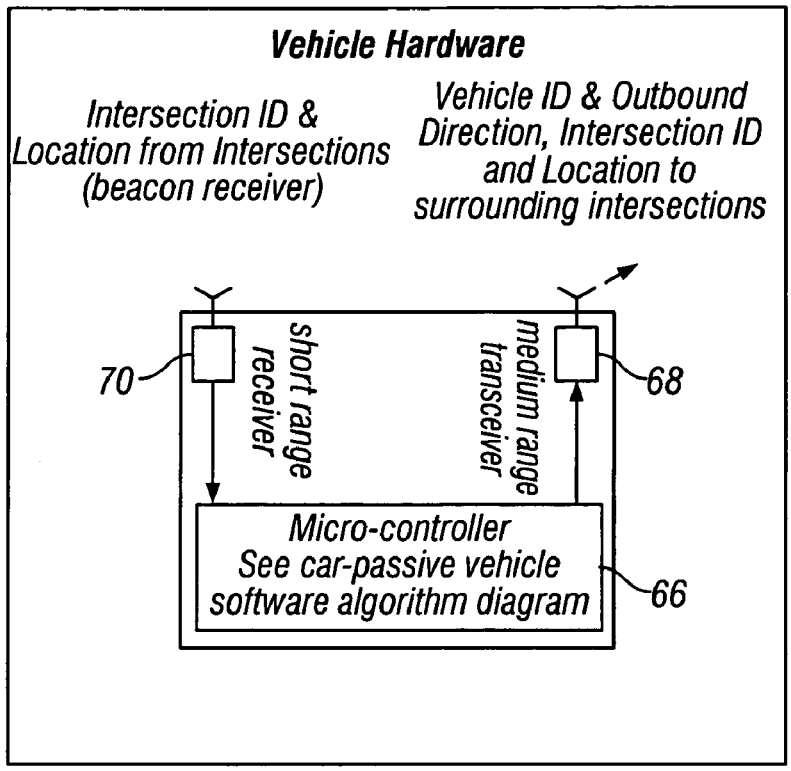
FIG. 7 is a block diagram illustrating the vehicle hardware for the emergency vehicle intersection preemption system in the "car-passive" embodiment according to the invention.
Figure 8:
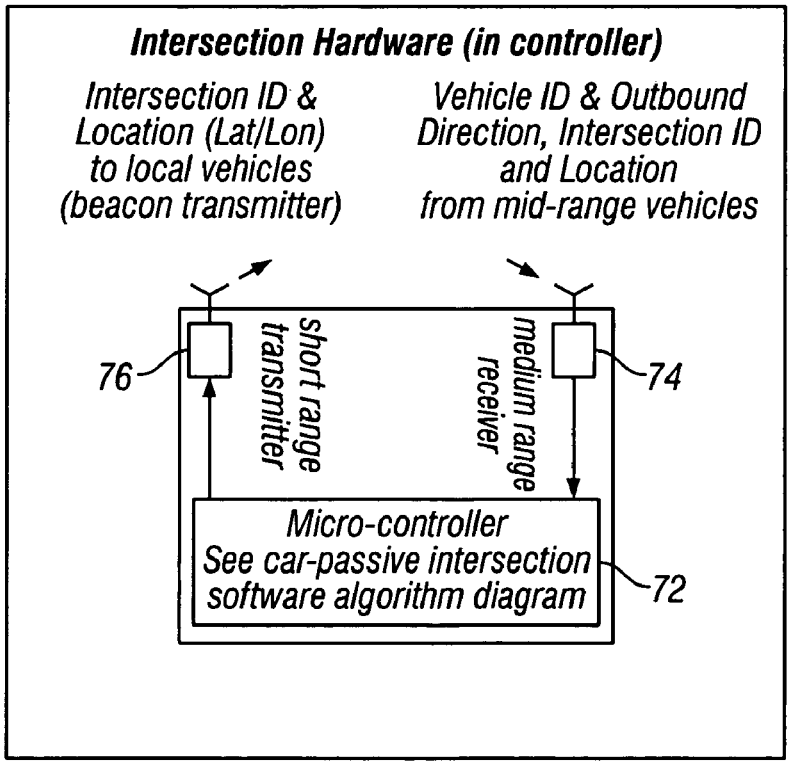
FIG. 8 is a block diagram illustrating the intersection hardware for the emergency vehicle intersection preemption system for the "car-passive" embodiment.

An optional but less preferred "car-passive" emergency vehicle intersection preemption system is illustrated in FIGS. 7 through 12. The vehicle hardware is illustrated in FIG. 7 and comprises vehicle hardware micro-controller 66, medium-range transceiver 68, and short-range receiver 70. Vehicle hardware micro-controller 66 and medium-range transceiver 68 transmit vehicle ID and outbound direction, intersection ID, and location to surrounding intersections. Short-range receiver 70 receives intersection ID and location from intersections from the intersection hardware shown in FIG. 8.

Intersection hardware is comprised of micro-controller 72, medium-range receiver 74, and short-range transmitter 76. Micro-controller 72 and medium-range receiver 74 receive vehicle ID and outbound direction, intersection ID, and location from mid-range vehicles. Short-range transmitter 76 (i.e., beacon transmitter) transmits intersection ID and location (Lat/Lon) to all local emergency vehicles.

Figure 10A:
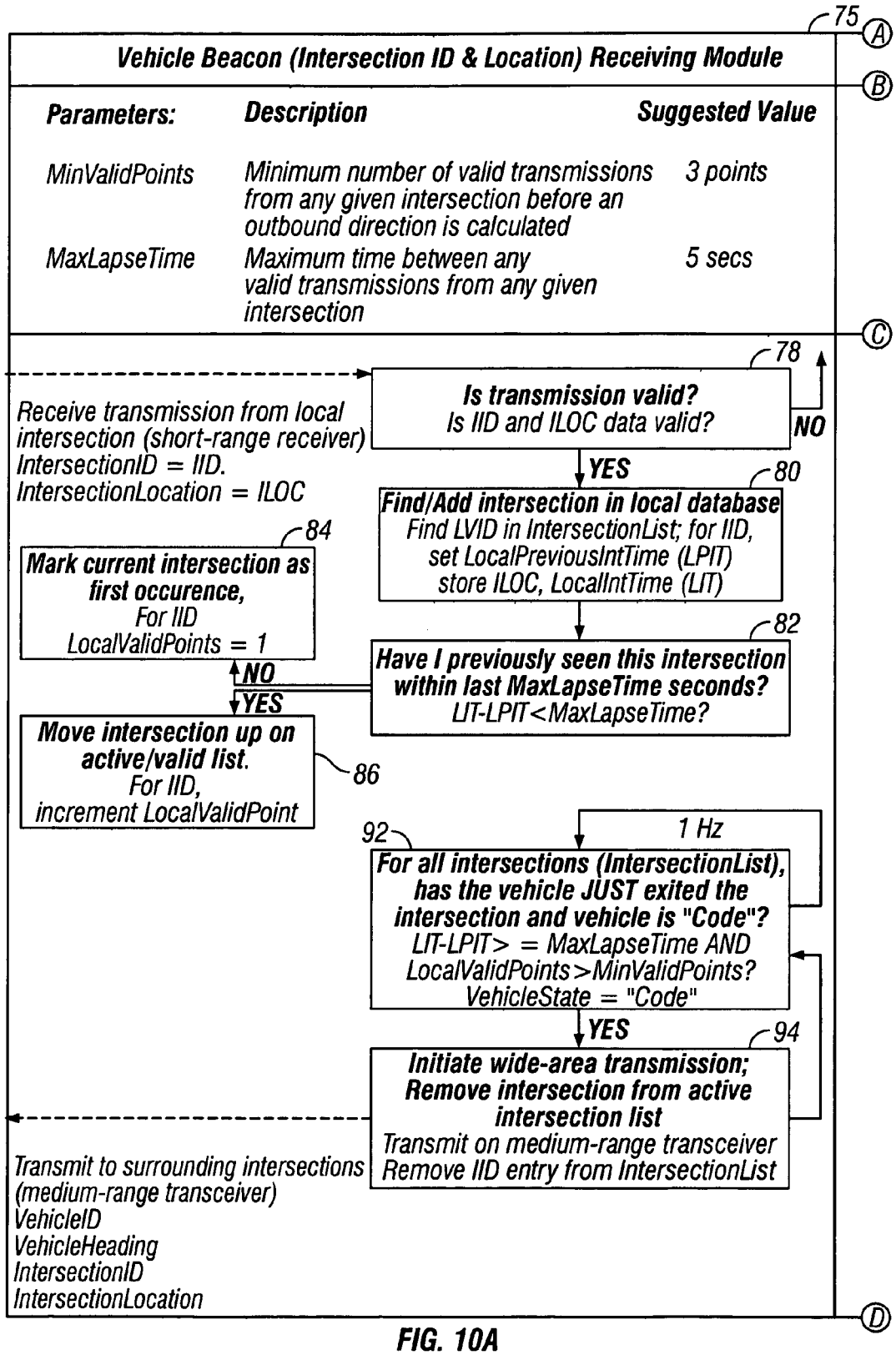
FIG. 10 is a diagram of the "car-passive" software algorithm for the vehicle beacon receiving module.
Figure 10B:
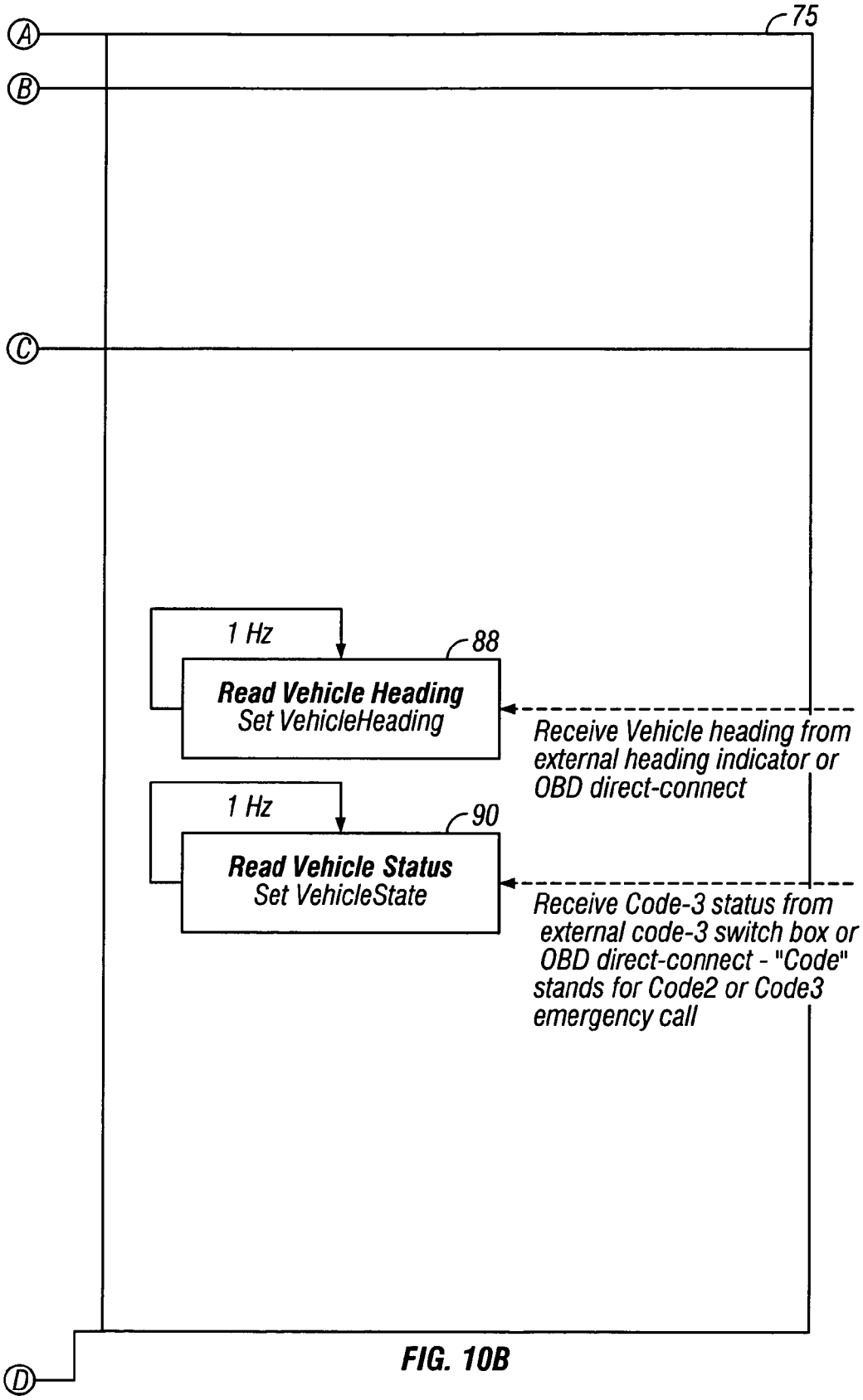

A "car-passive" vehicle software algorithm diagram is illustrated in FIG. 10. In this software algorithm diagram, vehicle beacon receiving module 75 receives transmissions from a local intersection (short-range receiver). Vehicle beacon receiving module 75 checks for whether the transmission is valid 78, finds and adds the intersection to local database 80, and checks whether this intersection has been seen within a certain time period 82. If it has not been seen, it marks this as the first occurrence of this intersection 84, otherwise it marks the intersection up on the active/valid list 86.

Vehicle beacon receiving module 75 also has a read vehicle heading 88 that receives vehicle heading from an external heading indicator or OBD direct-connect computer. In addition, it has a read vehicle status 90 receiving Code 3 status from external Code 3 switchbox or OBD direct-connect computer. In addition, vehicle beacon receiving module 75 has a just-exited intersection step 92 and initiates wide-area transmission 94 to transmit to surrounding intersections (medium-range transceiver) the vehicle ID, vehicle heading, intersection ID, and intersection location.

Figure 11:
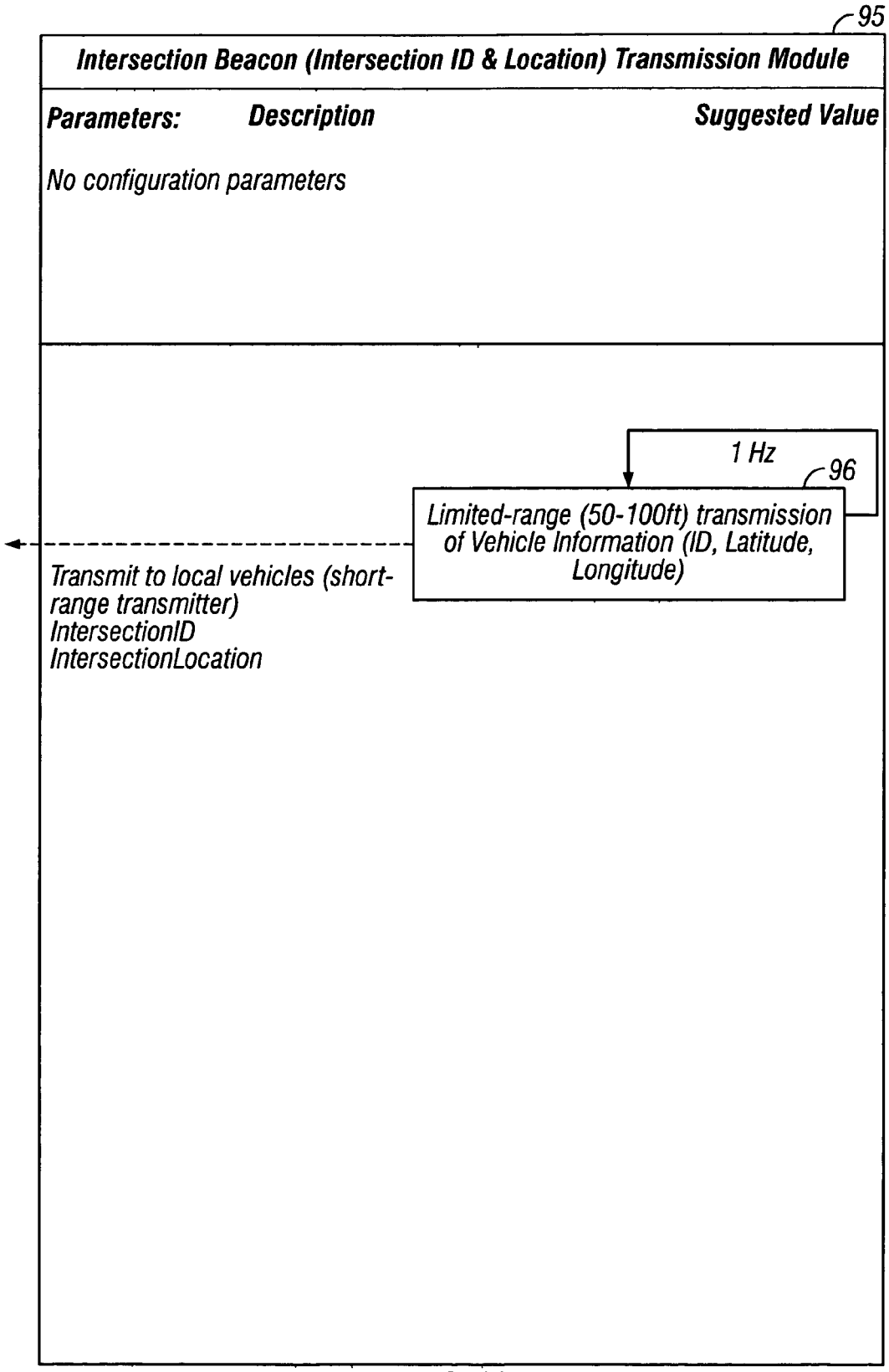
FIG. 11 is a diagram of the "car-passive" software algorithm for the intersection beacon transmission module.
Figure 12:
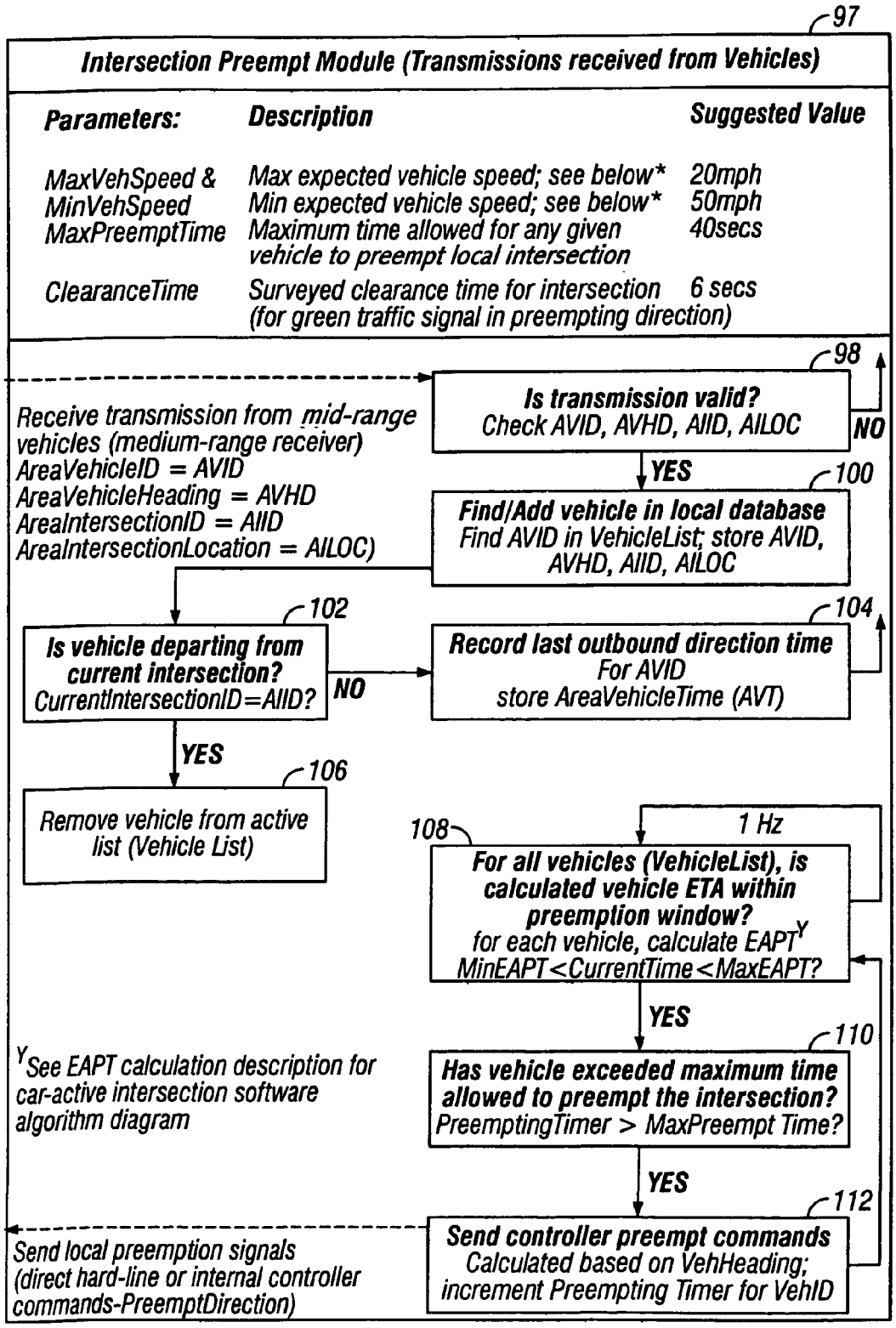
FIG. 12 is a diagram of the "car-passive" software algorithm for the intersection preempt module.

The software algorithms for intersection micro-controller 72 are illustrated in FIGS. 11 and 12. Intersection beacon transmission module 95 has a limited range transmission of vehicle information 96 that transmits to all local emergency vehicles (short-range transmitter), the intersection ID, and intersection location.

Intersection preempt module 97 software algorithm has a transmission valid check 98 which provides an output if "yes" to a find/add vehicle to local database 100. Intersection preempt module 97 then determines if the vehicle is departing the current intersection 102 and if not, records the last outbound direction 104. If the vehicle is departing the intersection then the vehicle is removed from the active list 106. Intersection preempt module 97 also includes whether the vehicle ETA is within a preemption window 108 and if it is, determines if it exceeded the maximum time allowed for preemption 110. If the maximum preemption time has been exceeded, controller preempt commands are sent 112 which include internal controller commands and preempt direction.

Figure 9:
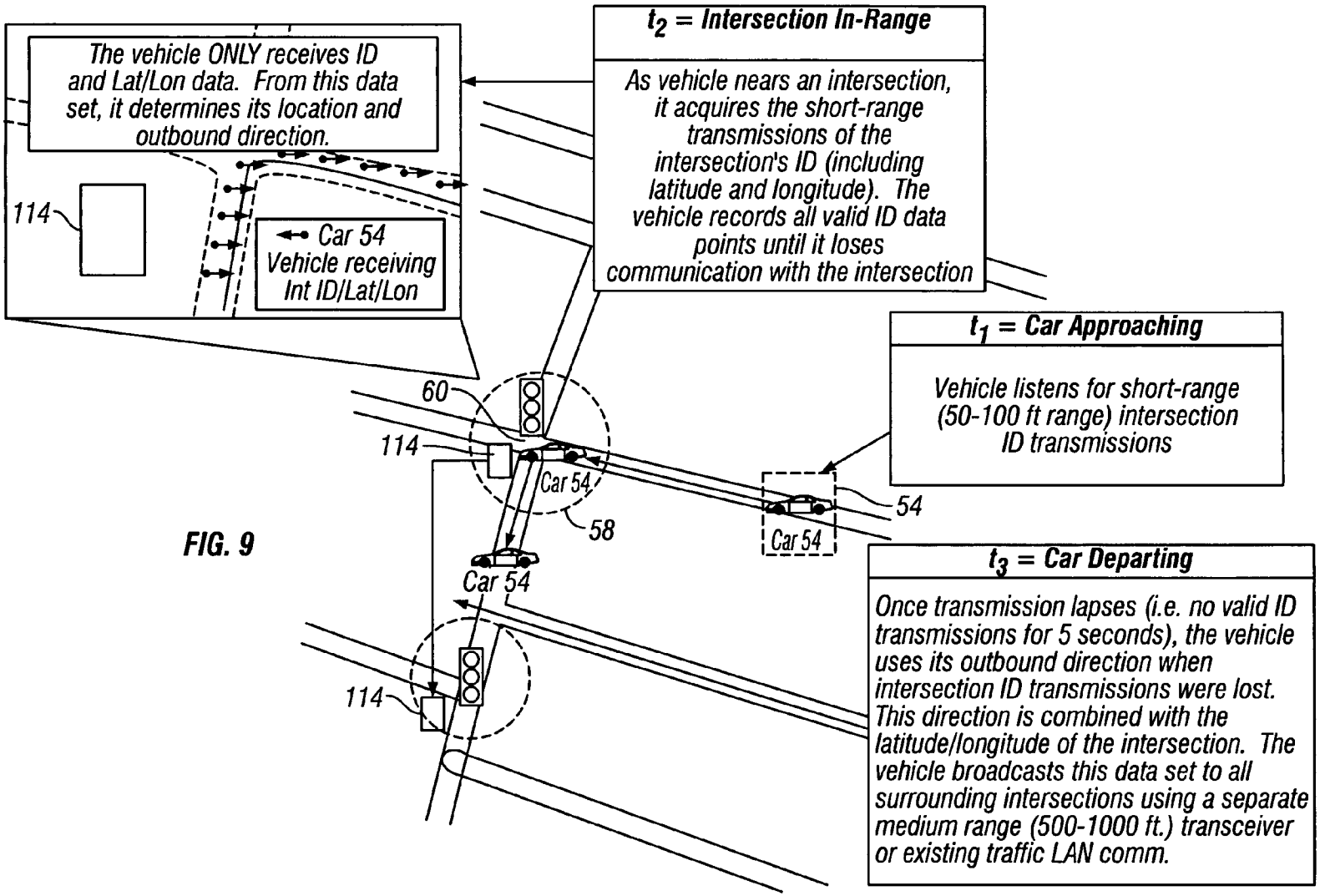
FIG. 9 is a diagram illustrating the timing sequence for a heading-beacon emergency vehicle intersection preemption system in the "car-passive" embodiment.

A timing sequence for the heading/beacon emergency vehicle intersection preemption system utilizing the "car-passive" technology is illustrated in FIG. 9 wherein like reference numbers indicate like components throughout. Timing sequence $t_1$ for emergency vehicle 54 listens for short-range transmissions from intersection 60. When emergency vehicle 54 reaches intersection 60 at timing sequence $t_2$, it acquires short-range transmissions of an intersection's ID including latitude and longitude. Emergency vehicle 54 records all valid ID data points until it loses communication with intersection 60.

The electronic module with beacon transmitter 76 (FIG. 8) is inside the intersection controller 114. Beacon transmitter 76 in intersection controller 144 transmits only ID and latitude and longitude data. From this data, emergency vehicle 54 determines its location and outbound direction. At timing sequence $t_3$ once the transmission lapses (i.e., no valid ID transmission for five seconds), emergency vehicle 54 uses its outbound direction when intersection ID transmissions are lost. The direction is combined with the latitude/longitude of the intersection, emergency vehicle 54 broadcasts this data set to all surrounding intersections using a separate medium-range transceiver 68 (FIG. 7), or existing traffic LAN communications.

As shown in the intersection software algorithm diagrams, the baseline design for the intersection hardware uses any off-the-shelf micro-controller for implementation of embedded code. The function of intersection micro-controllers 14 and 72 can be integrated into actual intersection controllers 63 and 114. This can be implemented in any intersection traffic signal controller that allows software add-on modules. In this case, the intersection controller would only need to provide the short-range and medium-range communication ports required for RF data transfer. Additionally, in the configuration where LAN lines (fiber, FSK, etc.) exist between intersections, the medium-range transceiver network could be replaced with the direct hard-line communications. This would further reduce the cost of the intersection module.

Thus there has been disclosed an emergency vehicle intersection preemption beacon/heading system and method that controls the operation of traffic lights at an intersection to avoid accidents. In one embodiment, the system is "car-active" in which a transmitter is provided in each emergency vehicle to transmit to the intersection the appropriate information to control the operation of the traffic lights. In a second, alternate less preferred "car-passive" embodiment, a localized, short-range transmitter is placed in the traffic light controller box to control the operation of all traffic lights according to the position, direction, and location of emergency vehicles.

This invention is not to be limited by the embodiment shown in the drawings and described in the description which is given by way of example and not of limitation, but only in accordance with the scope of the appended claims.

What is claimed is:

1. An intersection preemption system comprising:

a first transmitter coupled to a first intersection transmitting data;

a receiver coupled to a vehicle for receiving the data from said first transmitter;

a processor in said vehicle coupled to the receiver, the processor identifying location information of the first intersection responsive to the received data;

a second transmitter coupled to the vehicle, the second transmitter forwarding vehicle heading and vehicle location information to a second intersection, the second intersection being configured to control flow of traffic at the second intersection based on the vehicle heading and vehicle location information.

2. The system according to claim 1, wherein the first transmitter is a short-range beacon transmitter and the receiver is a short-range beacon receiver.

3. The system according to claim 1, wherein said second intersection is configured to calculate the estimated time of arrival of said vehicle, and send preemption commands to a traffic light controller at said second intersection for preempting traffic lights coupled to the second intersection.

4. The system according to claim 1, wherein the second transmitter is a medium-range transceiver.

5. The system of claim 1, wherein the vehicle location information is the identified location information of the first intersection.

6. The system of claim 1, wherein the vehicle heading information includes direction information for the vehicle upon exiting the first intersection.

7. The system of claim 1, wherein the second transmitter transmits the vehicle heading and vehicle location information responsive to a lapse of communication between the first intersection and the vehicle.

8. The system of claim 1 further comprising a dead-reckoning device coupled to the vehicle for recalibrating the vehicle location information to the identified location information of the first intersection.

9. An intersection preemption method comprising:

transmitting data by a first transmitter coupled to a first intersection;

receiving by a receiver coupled to a vehicle the data transmitted by the first transmitter;

identifying location information of the first intersection responsive to the received data;

determining vehicle location based on the location information of the first intersection;

transmitting to a second intersection by a second transmitter coupled to the vehicle, vehicle heading and vehicle location information, the second intersection being configured to control flow of traffic at the second intersection based on the vehicle heading and vehicle location information.

10. The method according to claim 9, wherein said first transmitter is a short-range beacon transmitter.

11. The method according to claim 9, wherein said second transmitter is a medium-range transceiver in said vehicle.

12. The method of claim 9, wherein the determining includes recalibrating the vehicle location information to the identified location information of the first intersection.

13. The method of claim 9, wherein the vehicle heading information includes direction information for the vehicle upon exiting the first intersection.

14. The method of claim 9, wherein the second transmitter transmits the vehicle heading and vehicle location information responsive to a loss of signal between the first transmitter and the receiver.

15. An intersection preemption system comprising:

a receiver coupled to a first intersection receiving vehicle heading information transmitted by a vehicle;

a processor coupled to the receiver at the first intersection, the processor determining an outbound direction for the vehicle based on the vehicle heading information and forwarding the outbound direction and information associated with the first intersection to a second intersection, the second intersection being configured to control flow of traffic at the second intersection based on the outbound direction of the vehicle and the information associated with the first intersection.

16. The system of claim 15, wherein the processor forwards the outbound direction for the vehicle and the information associated with the first intersection responsive to a lapse of communication with the vehicle.

17. The system of claim 15, wherein the receiver receives updated vehicle heading information at periodic intervals.

18. The system of claim 17, wherein the processor accumulates a plurality of vehicle heading data points and maps the heading data points onto a local street map.

19. The system of claim 15, wherein the information associated with the first intersection includes location information of the first intersection.

20. An intersection preemption method comprising:

receiving at a first intersection, vehicle heading information transmitted by a vehicle;

determining an outbound direction for the vehicle based on the vehicle heading information; and forwarding the outbound direction and information associated with the first intersection to a second intersection, the second intersection being configured to control flow of traffic at the second intersection based on the outbound direction of the vehicle and the information associated with of the first intersection.

21. The method of claim 20, wherein the outbound direction information and the information associated with the first intersection are forwarded responsive to a lapse of communication with the vehicle.

22. The method of claim 20, wherein the vehicle heading information is received at periodic intervals.

23. The method of claim 22 further comprising:

accumulating a plurality of vehicle heading data points; and mapping the heading data points onto a local street map.

24. The method of claim 20, wherein the information associated with the first intersection includes location information of the first intersection.

* * * * *